US006726583B1

(12) United States Patent
Lai

(10) Patent No.: US 6,726,583 B1
(45) Date of Patent: Apr. 27, 2004

(54) GAME BALL

(75) Inventor: I-Chuan Lai, Taichung Hsien (TW)

(73) Assignee: Ye Gin Enterprise, Co., Ltd., Taichung Hsien (TW)

( * ) Notice: Subject to any disclaimer, the term of this patent is extended or adjusted under 35 U.S.C. 154(b) by 0 days.

(21) Appl. No.: 10/366,154

(22) Filed: Feb. 13, 2003

(51) Int. Cl.[7] ..... A63B 41/10
(52) U.S. Cl. ..... 473/605; 473/599
(58) Field of Search ..... 473/603, 604, 473/605, 598, 599

(56) References Cited

U.S. PATENT DOCUMENTS

| | | | | | |
|---|---|---|---|---|---|
| 1,923,236 | A | * | 8/1933 | Sonnett | 473/599 |
| 3,119,618 | A | * | 1/1964 | Molitor et al. | 473/599 |
| 5,772,545 | A | * | 6/1998 | Ou | 473/605 |
| 6,402,647 | B1 | * | 6/2002 | Haseltine | 473/605 |
| 6,503,162 | B1 | * | 1/2003 | Shishido et al. | 473/605 |

* cited by examiner

*Primary Examiner*—Steven Wong
(74) *Attorney, Agent, or Firm*—Trop, Pruner & Hu, P.C.

(57) ABSTRACT

A game ball includes a carcass made up of a plurality of multi-layered carcass segments that are sewn together to form the carcass. Each carcass segment has a major portion and a marginal portion that surrounds the major portion and that is thinner than the major portion.

8 Claims, 4 Drawing Sheets

GAME BALL

BACKGROUND OF THE INVENTION

1. Field of the Invention

The invention relates to a game ball, more particularly to a game ball that has a carcass which is formed by sewing together a plurality of carcass segments.

2. Description of the Related Art

A conventional game ball (not shown) has a carcass which is formed by sewing together a plurality of single-layered carcass segments. However, the game ball of this construction suffers from poor feeling of contact. Moreover, sewing threads protrude out easily among the carcass segments such that during an action game, the sewing threads are easily damaged, thereby shortening the service life of the game ball. Furthermore, the thickness of the carcass segments is uniform such that the curvature of the ball is adversely affected after the carcass segments are sewn together.

Referring to FIGS. 1 and 2, another conventional game ball is shown to have a carcass which is formed by sewing together a plurality of multi-layered carcass segments 50, each of which includes an outer layer 1, an intermediate foam layer 2 adhered to an inner surface of the outer layer 1, and an inner cloth layer 3 adhered to an inner surface of the foam layer 2. Although this kind of game ball has good feeling of contact, the sewing threads 4 still protrude out easily among the carcass segments 50 such that the sewing threads are easily damaged and the service life of the game ball is accordingly shortened. Furthermore, the thickness of the carcass segments 50 is uniform such that the curvature of the game ball is adversely affected after the carcass segments 50 are sewn together.

SUMMARY OF THE INVENTION

Therefore, the object of the present invention is to provide a game ball that has a carcass which is capable of overcoming the aforementioned drawbacks of the prior art.

According to this invention, a game ball comprises a carcass made up of a plurality of carcass segments, which are sewn together so as to form the carcass. Each of the carcass segments has a major portion and a marginal portion that surrounds the major portion and that is thinner than the major portion, and includes an outer layer, an intermediate layer, and an inner layer. The outer layer has an outer surface, an inner surface opposite to the outer surface, a center, and a periphery. The intermediate layer is adhered to the outer layer, and has a shape that corresponds to that of the outer layer. The intermediate layer has an outer surface adhered to the inner surface of the outer layer, an inner surface opposite to the outer surface of the intermediate layer, and a periphery. The inner layer is adhered to the inner surface of the intermediate layer, and has a shape that corresponds to that of the outer layer. The inner layer has a periphery heat-sealed to the inner surfaces of the outer and intermediate layers.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
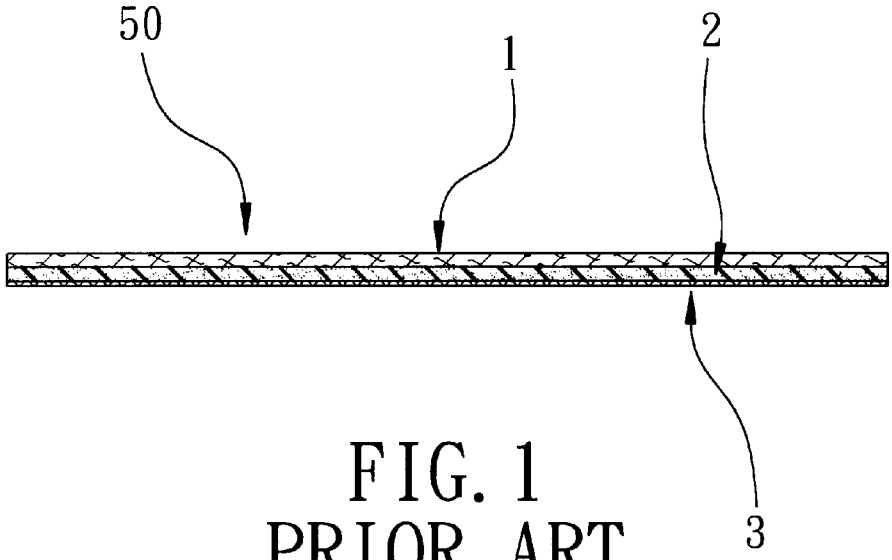
FIG. 1 PRIOR ART
FIG. 1 is a sectional view of a carcass segment of a conventional game ball.
Figure 2:
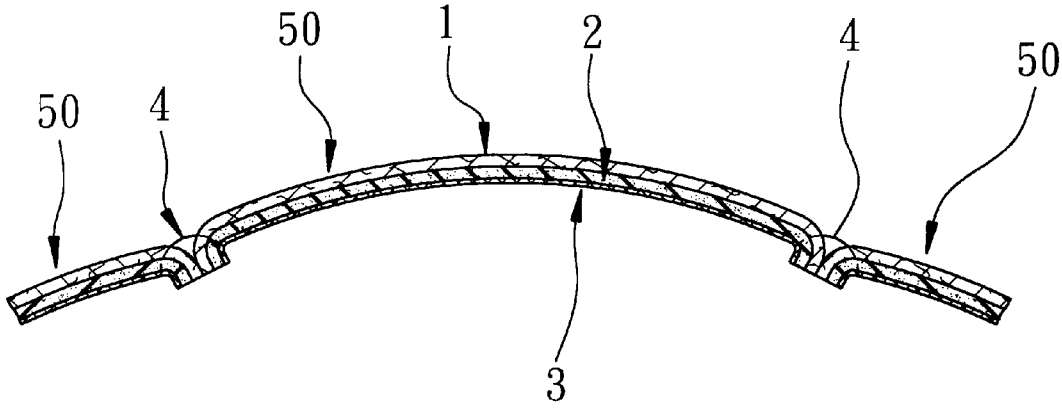
FIG. 2 PRIOR ART
FIG. 2 is a fragmentary sectional view of the conventional game ball, illustrating how carcass segments of the game ball of FIG. 1 are sewn together to form the game ball.
Figure 3:
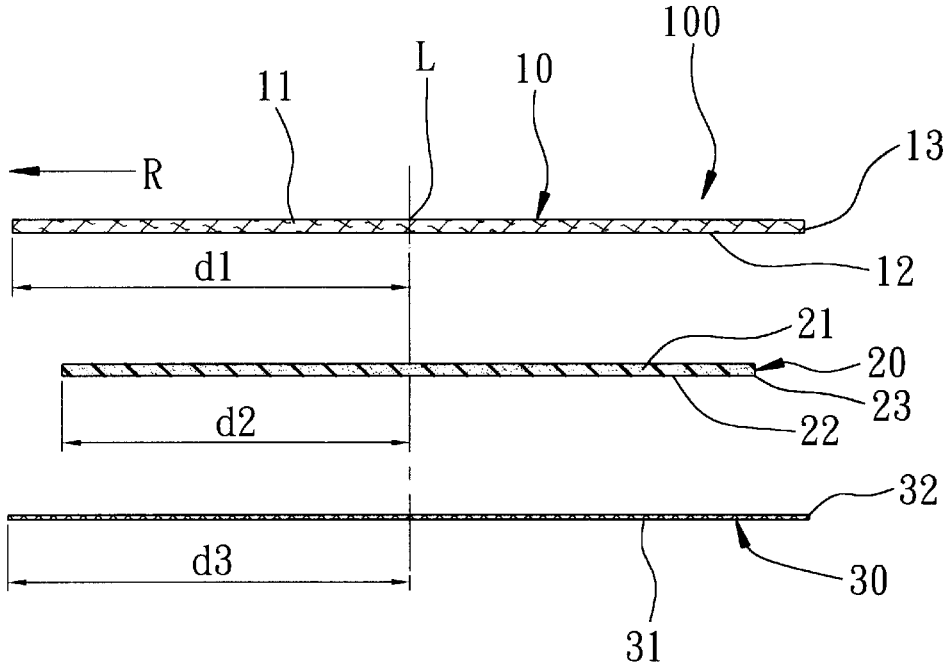
FIG. 3 is an exploded sectional view of a carcass segment of the first preferred embodiment of a game ball according to the present invention.
Figure 4:
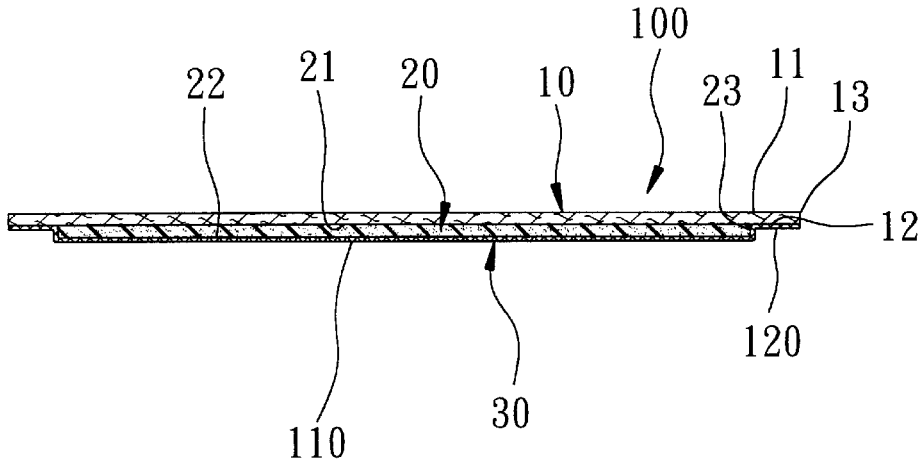
FIG. 4 is a sectional view of the carcass segment of the first preferred embodiment in an assembled state.
Figure 5:
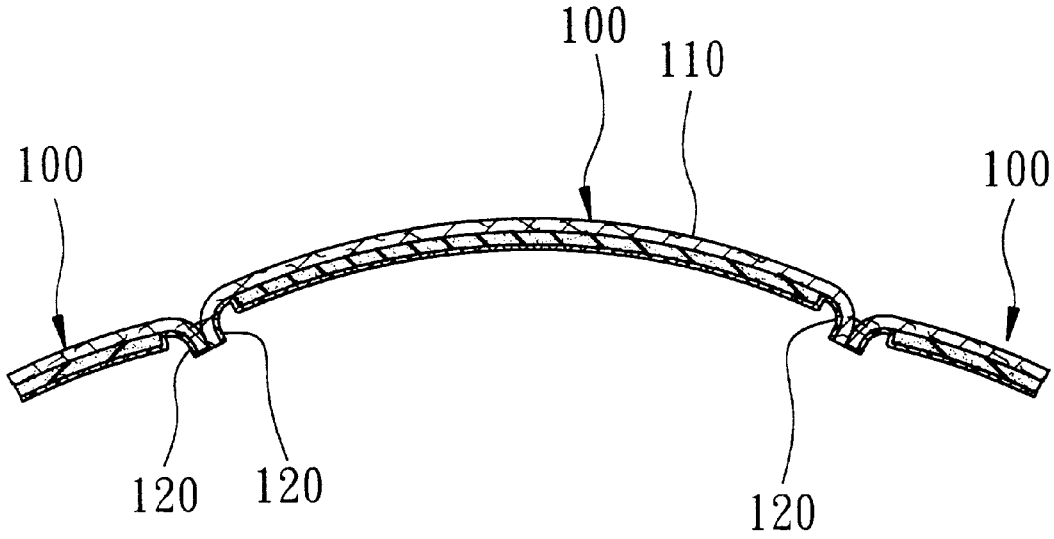
FIG. 5 is a fragmentary sectional view of the first preferred embodiment, illustrating how the carcass segments of the first preferred embodiment are sewn together to form the game ball.

Referring to FIGS. 3 to 5, the first preferred embodiment of a game ball according to the present invention comprises a carcass (a portion thereof is shown in FIG. 5) made up of a plurality of carcass segments 100, which are sewn together so as to form the carcass. Each of the carcass segments 100 has a major portion 110 and a marginal portion 120 that surrounds the major portion 110 and that is thinner than the major portion 110. Each of the carcass segments 100 includes an outer layer 10, an intermediate layer 20, and an inner layer 30. Since the carcass segments 100 are substantially similar in construction, only one of the carcass segments 100 will be described hereinafter.

The outer layer 10 of the carcass segment 100 is made of a soft and high-strength material, such as natural leather or synthetic leather. In this embodiment, the outer layer 10 is hexagonal in shape, and has six sides, each of which is 80 mm long. The outer layer 10 has an outer surface 11, an inner surface 12 opposite to the outer surface 1 , a center (L) , and a periphery 13 having a first distance (d1) from the center (L) along a radial direction (R) with respect to the center (L), as shown in FIG. 3.

The intermediate layer 20 of the carcass segment 100 is made of a highly elastic foam material, has a uniform thickness, is adhered to the outer layer 10, and is also hexagonal in shape. The intermediate layer 20 has an outer surface 21 adhered to the inner surface 12 of the outer layer 10, an inner surface 22 opposite to the outer surface 21 of the intermediate layer 20, and a periphery 23 having a second distance (d2) from the center (L) along the radial direction (R), as shown in FIG. 3. The second distance (d2), in this embodiment, is shorter than the first distance (d1) by about 5 mm so that the periphery 23 of the intermediate layer 20 extends inside the periphery 13 of the outer layer 10.

The inner layer 30 of the carcass segment 100 is made of a high-strength woven fiber fabric, and is adhered to the inner surface 22 of the intermediate layer 20. The inner layer 30 has a shape that corresponds to that of the outer layer 10, is stepped, and has a central portion 31 and a periphery 32 having a third distance (d3) from the center (L) along the radial direction (R) In this embodiment, the third distance (d3) is longer than the first distance (d1) by about 0.5 mm. The central portion 31 corresponds to the major portion 110 of the carcass segment 110, and abuts against the inner surface 22 of the intermediate layer 20. The periphery 32 of the inner layer 30 corresponds to the marginal portion 120 of the carcass segment 100, has a peripheral edge flush with that of the periphery 13 of the outer layer 10, and is heat-sealed to the inner surfaces 12, 22 of the outer and intermediate layers 10, 20.

When the outer layer 10, the intermediate layer 20, and the inner layer 30 are adhered to one another by means of a strong adhesive, the periphery 32 of the inner layer 30 is directly adhered to the inner surface 12 of the outer layer 10 so that the intermediate layer 20 is fully covered between the outer layer 10 and the inner layer 30. After the composite structure is formed, it is subjected to a high-frequency heat-sealing process using a copper die to produce the carcass segment 100. The resulting carcass segment 100 has the major portion 110 constituting the area within the periphery 23 of the intermediate layer 20, and the marginal portion 120 that surrounds an outer periphery of and that is thinner than the major portion 110.

Referring back to FIG. 5, when adjacent pairs of the carcass segments 100 are sewn together, the resulting carcass of the game ball of the present invention has the following advantages:

1. Since the marginal portion 120 of each carcass segment is thinner, it is more bendable than the major portion 110 so that when adjacent pairs of the carcass segments 100 are sewn together along the marginal portions 120, the sewing threads are hidden, thereby protecting the sewing threads from being easily damaged, and thereby prolonging the service life of the game ball of the present invention.

2. Since stitches are made on the marginal portions 120 of adjacent pairs of the carcass segments 100, the tensile forces of the sewing threads cannot affect the major portions 110 of the carcass segments 100 so that the curvature of the game ball can be ensured, thereby providing the game ball of the present invention with good balance function.

Figure 6:
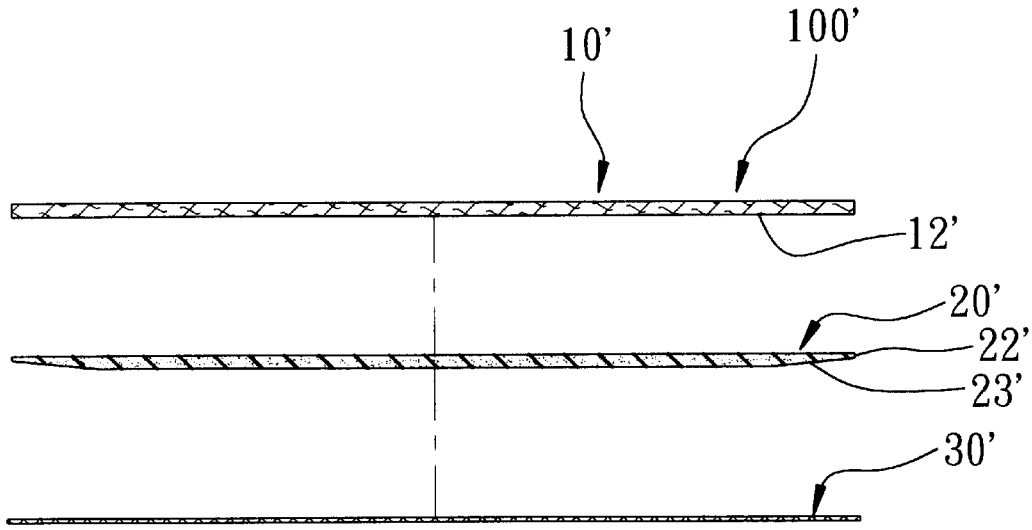
FIG. 6 is an exploded sectional view of a carcass segment of the second preferred embodiment of the game ball according to the present invention.
Figure 7:
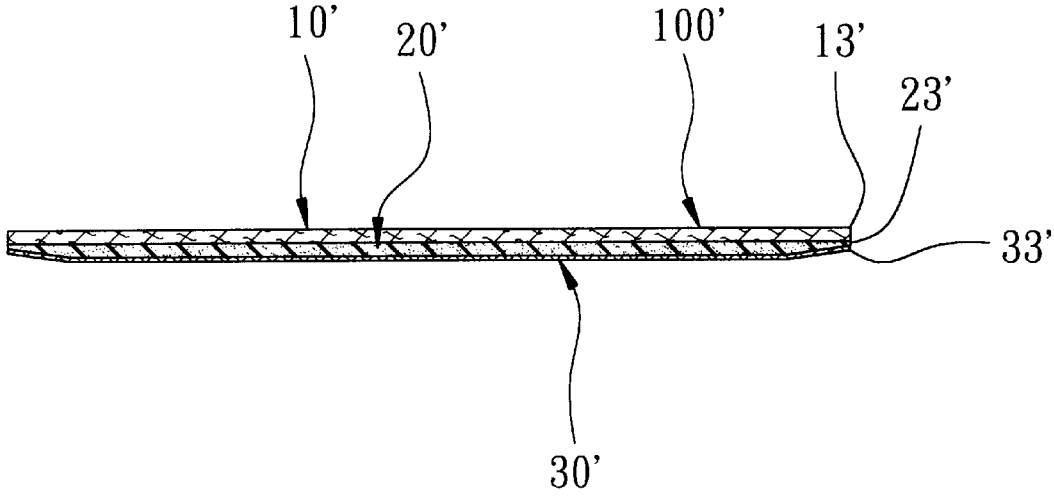
FIG. 7 is a sectional view of the carcass segment of the second preferred embodiment in an assembled state.

Referring to FIGS. 6 and 7, the second preferred embodiment of the game ball according to the present invention is shown to be substantially similar to the first preferred embodiment. Particularly, the game ball comprises a carcass made up of a plurality of carcass segments 100' (only one is shown) , each of which includes an outer layer 10', an intermediate layer 20' adhered to an inner surface 12' of the outer layer 10', and an inner layer 30' adhered to an inner surface 23' of the intermediate layer 20'. The main difference between the first and second preferred embodiments resides in that peripheries 13',23',33' of the outer, intermediate, and inner layers 10', 20', 30' have edges that are flush with one another. The periphery 23' of the intermediate layer 20' has a thickness smaller than that of the remaining portion of the intermediate layer 20'.The periphery 33' of the inner layer 30' is heat-sealed to the inner surface 22' and the periphery 23' of the intermediate layer 20'.

It should be noted that the carcass segments 100, 100' of the game ball of the present invention can be made into different shapes and is suitable for different kinds of game balls, such as football, soccer ball, etc.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A game ball comprising:

a carcass made up of a plurality of carcass segments, which are sewn together so as to form said carcass, each of said carcass segments having a major portion and a marginal portion that surrounds said major portion and that is thinner than said major portion, and including an outer layer having an outer surface, an inner surface opposite to said outer surface, a center, and a periphery, an intermediate layer adhered to said outer layer, and having a shape that corresponds to that of said outer layer, said intermediate layer having an outer surface adhered to said inner surface of said outer layer, an inner surface opposite to said outer surface of said intermediate layer, and a periphery, and an inner layer adhered to said inner surface of said intermediate layer, and having a shape that corresponds to that of said outer layer, said inner layer having a periphery heat-sealed to said inner surfaces of said outer and intermediate layers, and said inner layer has an area slightly larger than that of said outer layer.

2. The game ball of claim 1, wherein said periphery of said outer layer has a first distance from said center along a radial direction with respect to said center, said periphery of said intermediate layer having a second distance from said center along the radial direction that is shorter than said first distance so that said periphery of said intermediate layer extends inside said periphery of said outer layer, said intermediate layer having a uniform thickness, said inner layer being stepped and having a central portion that abuts against said inner surface of said intermediate layer, said periphery of said inner layer abutting against said inner surface of said outer layer.

3. The game ball of claims 1, wherein said periphery of said intermediate layer has a thickness that is smaller than that of the remaining portion of said intermediate layer, said peripheries of said outer, intermediate, and inner layers having edges that are flush with one another.

4. The game ball of claim 3, wherein said periphery of said inner layer is heat-sealed to said inner surface and said periphery of said intermediate layer.

5. A game ball comprising:

a carcass made up of a plurality of carcass segments, which are sewn together so as to form said carcass, each of said carcass segments having a major portion and a marginal portion that surrounds said major portion and that is thinner than said major portion, and including an outer layer having an outer surface, an inner surface opposite to said outer surface, a center, and a periphery, an intermediate layer adhered to said outer layer, and having a shape that corresponds to that of said outer layer, said intermediate layer having an outer surface adhered to said inner surface of said outer layer, an inner surface opposite to said outer surface of said intermediate layer, and a periphery, and an inner layer adhered to said inner surface of said intermediate layer, and having a shape that corresponds to that of said outer layer, said inner layer having a periphery heat-sealed to said inner surfaces of said outer and intermediate layers, wherein said periphery of said outer layer has a first distance from said center along a radial direction with respect to said center, said periphery of said intermediate layer having a second distance from said center along the radial direction that is shorter than said first distance so that said periphery of said intermediate layer extends inside said periphery of said outer layer, said intermediate layer having a uniform thickness, said inner layer being stepped and having a central portion that abuts against said inner surface of said intermediate layer, said periphery of said inner layer abutting against said inner surface of said outer layer, and wherein said periphery of said outer layer has a first distance from said center along a radial direction with respect to said center, said periphery of said intermediate layer having a second distance from said center along the radial direction that is shorter than said first distance so that said periphery of said intermediate layer extends inside said periphery of said outer layer, said intermediate layer having a uniform thickness, said inner layer being stepped and having a central portion that abuts against said inner surface of said intermediate layer, said periphery of said inner layer abutting against said inner surface of said outer layer.

6. The game ball of claim 5, wherein said inner layer has an area slightly larger than that of said outer layer.

7. The game ball of claim 6, wherein said periphery of said intermediate layer has a thickness that is smaller than that of the remaining portion of said intermediate layer, said peripheries of said outer, intermediate, and inner layers having edges that are flush with one another.

8. The game ball of claim 7, wherein said periphery of said inner layer is heat-sealed to said inner surface and said periphery of said intermediate layer.

* * * * *